United States Patent [19]

Meier et al.

[11] 4,383,772

[45] May 17, 1983

[54] SUPPORT FOR THE PAPER CARRIER IN TYPEWRITERS AND SIMILAR MACHINES

[75] Inventors: Heinz Meier; Dieter Stricker; Detlef Kammler, all of Berlin, Fed. Rep. of Germany

[73] Assignee: Triumph-Adler A.G. fur Buro- und Informationstechnik, Nuremberg, Fed. Rep. of Germany

[21] Appl. No.: 273,747

[22] Filed: Jun. 15, 1981

[30] Foreign Application Priority Data

Sep. 16, 1980 [DE] Fed. Rep. of Germany ..... 3034864

[51] Int. Cl.[3] ..... B41J 11/20

[52] U.S. Cl. ..... 400/55; 400/434.1; 400/649; 29/445

[58] Field of Search ..... 400/58, 59, 55, 434.1, 400/691, 692, 693, 656, 649; 29/445; 81/420, 425 R, 5.1 R, 5.1 B

[56] References Cited

U.S. PATENT DOCUMENTS

| | | | |
|---|---|---|---|
| 1,832,622 | 11/1931 | Dean | 400/59 X |
| 2,205,065 | 6/1940 | Newcomb | 400/434.1 X |
| 2,734,613 | 2/1956 | Kennedy, Jr. et al. | 400/376 |
| 2,831,562 | 4/1958 | Saliamonas | 400/641 |

FOREIGN PATENT DOCUMENTS

| | | | |
|---|---|---|---|
| 1906042 | 7/1964 | Fed. Rep. of Germany . | |
| 2500418 | 8/1975 | Fed. Rep. of Germany | 400/55 |

*Primary Examiner*—Edgar S. Burr
*Assistant Examiner*—Charles A. Pearson
*Attorney, Agent, or Firm*—Joseph R. Spalla

[57] ABSTRACT

A support for the paper carrier in typewriters or similar machines extends between a base frame and the paper carrier. The support not only has the function of interconnecting the base frame and the paper carrier but it also functions, due to the provision of a tool deformable slot, as an adjustable support whereby the platen mounted on the paper carrier can be adjusted both vertically and horizontally relative to a printing element.

2 Claims, 3 Drawing Figures

SUPPORT FOR THE PAPER CARRIER IN TYPEWRITERS AND SIMILAR MACHINES

This invention relates to structure for supporting a paper carrier in typewriters or similar machines; more particularly it relates to a structure which can be adjusted to adjust a platen rotatably mounted in the paper carrier vertically or horizontally.

It is necessary in typewriters to adjust the platen relative to a type carrier, particularly vertically. According to the state of the art, a number of devices to accomplish this are known. For example, German Design Pat. No. DE. GM 1,906,042 shows a support for the paper carrier which requires a relatively large number of components. These components must be made to close tolerances which makes the adjusting device very expensive to produce and assemble.

An object of the invention therefore is to provide a support for the paper carrier of a typewriter which is not only easy to produce, but permits a simple and convenient adjustment thereof to accurately locate a supported platen relative to a printing point.

Another object of the invention is in the provision of support structure in the form of a simple stamping which is designed to be deformed by a tool as required to adjust a supported paper carrier and the platen mounted thereon.

Other objects, features and advantages of the present invention will become known to those skilled in the art from a reading of the following detailed description when taken in conjunction with the accompanying drawing wherein like reference numerals designate like or corresponding parts throughout the several views thereof, and wherein.

Figure 1:
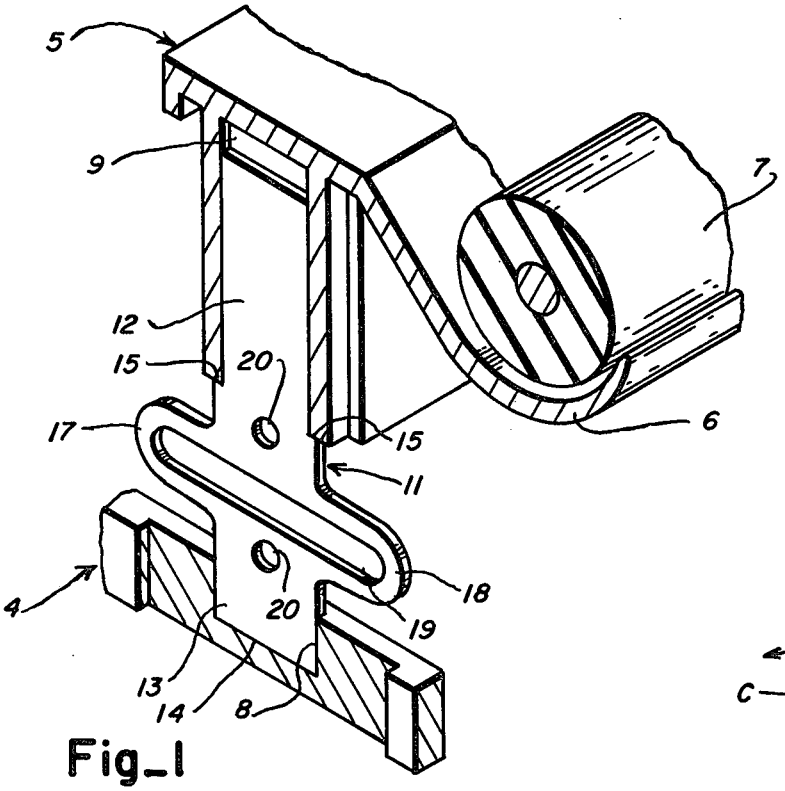
FIG. 1 is a partial perspective view of a paper carrier supported according to the invention, with elements in section.

Referring now to FIG. 1 there is as shown a portion of a side wall of a housing base generally designated by reference numeral 4 which may be the bottom pan of a typewriter, printer or similar machine, for example. Supported above the base 4 is paper carrier generally designated by reference numeral 5. The paper carrier 5 includes a paper trough 6 to guide a sheet of paper around a platen 7 rotatably supported on the paper carrier 5 in a known manner.

The paper carrier 5 is supported at its ends, only one of which is shown in FIG. 1, for adjustment vertically as well as angularly as will hereinafter appear whereby the platen 7 can be adjusted vertically and horizontally relative to a printing element, e.g. a type disc, to establish a printing line and the gap between the printing line and the printing element.

More particularly the support structure comprises slots 8 and 9 formed in the base 4 and paper carrier 5 respectively. In assembly the slots 8 and 9 are open to one another and generally aligned. The support structure includes a connecting part or support generally designed by reference numeral 11 which has upwardly and downwardly directed vertically aligned arms 12 and 13 which are adapted to be received within the slots 9 and 8 respectively. The lower edge 14 of the downwardly directed arm 13 of the support 11 rests directly on the bottom of the slot 8 in the base 4. The edges of the upwardly directed arm 12 of support 11 are provided with shoulders 15, which support the paper carrier 5. By designing the housing base 4 and the paper carrier 5 with appropriate dimensions, a predetermined basic position of the two parts relative to one another is assured.

Figure 2:
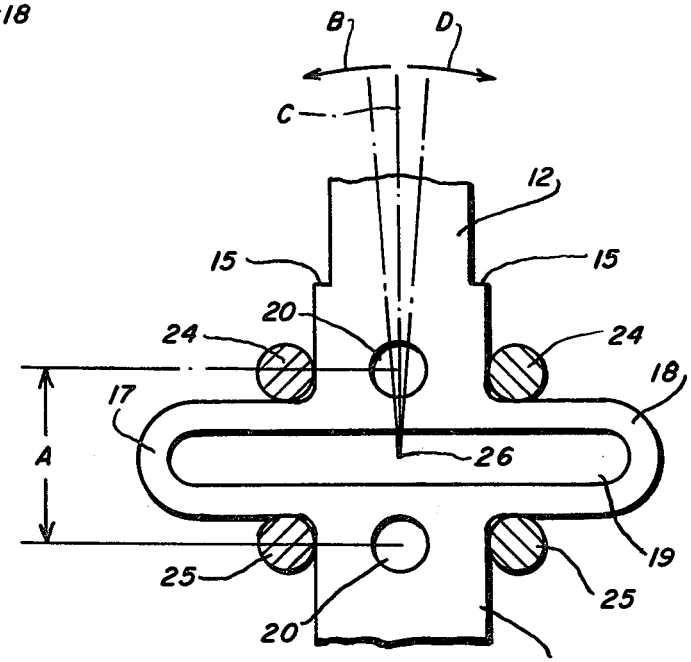
FIG. 2 is a partial elevational view of the support.

With reference to FIGS. 1 and 2, between the arms 12 and 13, the support 11 is formed with laterally extending projections 17 and 18 and with a lateral slot 19 which extends through said support 11 and into said projections 17 and 18 to provide a capacity for deformation to allow adjustment of said arms 12 and 13 relative to one another. As shown in FIGS. 1 and 2 holes 20 are provided in both arms 12 and 13 of the support 11 above and below the slot 19.

Figure 3:
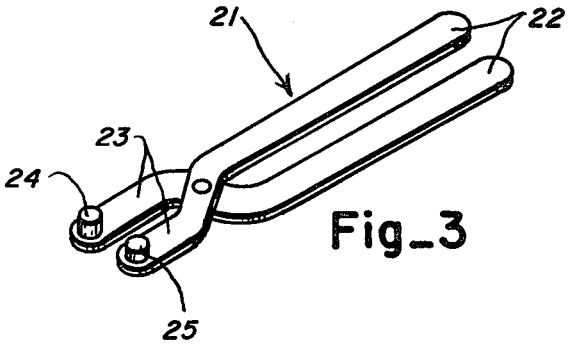
FIG. 3 is a perspective view of a tool with which to adjust the support and thereby the paper carrier and platen.

FIG. 3 shows a tool, generally designated by reference numeral 21, for the adjustment of the support 11. The tool 21 takes the form of pliers with handles 22 and jaws 23, the latter carrying lugs 24 and 25, respectively which extend at right angles to the plane of the pliers.

With reference to FIG. 2 the distance A between the two holes 20 in the support 11 can be adjusted by inserting the lugs 24 and 25 in them. Compressing the handles 22 of the pliers reduces the distance A, while pulling its handles 22 apart increases it. Thus, paper carrier 5 and the platen 7 can be vertically adjusted relative to a reference point, such as a type carrier.

The tool 21 can also be used to adjust the paper carrier 5 and the spacing of the platen 7 toward or away from a type carrier by positioning the lugs 24 and 25 above and below the leftwardly or rightwardly extending projections 17 and 18 as shown in FIG. 2. For example, if the plier lugs 24 and 25 are applied above and below the left projection 17 adjacent the vertical arms 12 and 13 of the support 11, as shown in FIG. 2, and the plier jaws 23 are brought together compressing the slot 19, a deflection of the upper arm 12 of the support 11 from the straight line C in the direction of arrow B is possible about a center 26 having its location at the midpoint of the slot 19. Similarly, by applying the plier lugs 24 and 25 above and below the right projection 18, and bringing the plier together, the slot 19 will be compressed and the arm 12 of support 11 deflected in arrow direction D. Thus, the slot 19 extending through the support 11 and projections 17 and 18 allows any desired adjustment of the support 11 and thus the platen supporting paper carrier 5 in a simple manner and without additional components.

The invention claimed is:

1. In a typewriter having a base and a paper carrier including a platen, support structure interconnecting said base and paper carrier comprising, vertical rectangular slots in said base and paper carrier, and a support having downwardly and upwardly directed arms for insertion into said vertical slots in said base and paper carrier respectively, thereby to support said paper carrier above said base, said support between said arms including laterally-extending projections, and an elongated slot extending laterally through said support into said lateral projections to provide the capacity for deformation to allow said oppositely directed arms to be vertically or angularly adjusted relative to one another by a plier like bending tool thereby to establish a writing line and the distance between said platen and a printing element.

2. Support structure as recited in claim 1, said upwardly and downwardly directed arms of said support having holes adjacent to said elongated slot to permit said elongated slot to be vertically expanded or contracted upon manipulation of said bending tool inserted into said holes.

* * * * *